United States Patent [19]

Yavorsky

[11] Patent Number: 5,035,722

[45] Date of Patent: Jul. 30, 1991

[54] METHOD OF EXTRACTING COAL FROM A COAL REFUSE PILE

[75] Inventor: Paul M. Yavorsky, Monongahela, Pa.

[73] Assignee: The United States of America as represented by the Secretary of the Interior, Washington, D.C.

[21] Appl. No.: 408,586

[22] Filed: Sep. 18, 1989

[51] Int. Cl.[5] ..... C10L 5/00; C10L 9/06

[52] U.S. Cl. ..... 44/605; 44/625

[58] Field of Search ..... 44/500, 589, 605, 607, 44/625

[56] References Cited

U.S. PATENT DOCUMENTS

| | | | |
|---|---|---|---|
| 4,054,420 | 10/1977 | Loganbach | 44/607 |
| 4,055,400 | 10/1977 | Stambaugh et al. | 44/607 |
| 4,522,626 | 6/1985 | Espenscheid | 44/625 |

*Primary Examiner*—Carl F. Dees

*Attorney, Agent, or Firm*—E. Philip Koltos

[57] ABSTRACT

A method of extracting coal from a coal refuse pile comprises soaking the coal refuse pile with an aqueous alkali solution and distributing an oxygen-containing gas throughout the coal refuse pile for a time period sufficient to effect oxidation of coal contained in the coal refuse pile. The method further comprises leaching the coal refuse pile with an aqueous alkali solution to solubilize and extract the oxidized coal as alkali salts of humic acids and collecting the resulting solution containing the alkali salts of humic acids. Calcium hydroxide may be added to the solution of alkali salts of humic acid to form precipitated humates useable as a low-ash, low-sulfur solid fuel.

14 Claims, No Drawings

METHOD OF EXTRACTING COAL FROM A COAL REFUSE PILE

FIELD OF THE INVENTION

The present invention relates to a method of extracting coal from a coal refuse pile, i.e., a coal waste pile. More particularly, the method of extracting coal from a coal refuse pile according to the present invention employs a combination of wet oxidation and alkali leaching techniques.

BACKGROUND OF THE INVENTION

Coal refuse piles are located throughout the United States and pose a significant environmental problem. The piles usually contain 30 to 70 percent coal and exhibit a significant tendency towards spontaneous combustion. In addition to the hazard of uncontrolled fire in a coal refuse pile, the resulting sulphurcontaining smoke is a significant air pollutant. Additionally, acidic drainage from coal refuse piles poses water pollution problems. The increasing number of coal refuse piles continually contributes to such adverse environmental problems. For example, it has been estimated that there are more than 2,000 coal refuse piles, each containing several million tons of refuse, in the Appalachian states alone.

Thus, a need exists for reducing the tendency towards spontaneous combustion in and preventing air and water pollution from coal refuse piles, preferably at minimal cost. In the past, these purposes have been achieved by the relocation and use of coal refuse piles as fill. The coal refuse has been combined with layers of impervious material in order to prevent spontaneous combustion and acid mine drainage. However, this method is disadvantageous owing to the relatively high expense of the impervious material and the required excavation and transport of the pile materials.

In another type of processing, the coal refuse piles have been excavated and transported into generic coal cleaning plants which employ conventional devices such as preferential agglomeration, cyclones, hydrocyclones, float-sink apparatus and the like. For example, in the convertol process, about 7 to 10 percent oil is mixed with finely pulverized coal refuse suspended in water. The water wets the coal but not the inorganic ash precursors. The wetted coal agglomerates on mild stirring and settles out for recovery as pellets while the ash material stays suspended for removal by decantation. While this process has been successfully used in the past, its desirability has been significantly reduced owing to the prohibitive cost of the oil employed therein. Similarly, the use of froth floatation for coal recovery from waste piles has been proposed but the cost of the necessary surfactants is disadvantageous. Additionally, these and similar processes performed in coal cleaning plants are disadvantageous for several further reasons. For example, costly excavation of the coal refuse piles is required. Additionally, large amounts of non-coal material contained in the piles are subjected to expensive transport and handling. Thus, the methods presently known in the art for treating coal refuse piles are not particularly suitable for widespread use.

The Seitzer U.S. Pat. No. 3,723,079 discloses a process for stabilizing dry lignitic and subbituminous coal against spontaneous combustion. The process comprises treating dried coal at a temperature of about 175 to about 225° C. with oxygen in an amount of from about 0.5 percent to about 8 percent by weight of the coal and rehydrating the oxygen-treated coal with water. The Fuchs U.S. Pat. No. 2,338,634 similarly discloses a method for the oxidation of coal wherein the coal is subjected to the action of an oxygen-containing gas at a first elevated temperature and then is heated in contact with air or another oxygen-containing gas at a lower temperature. The second heating stage may employ an oxidation catalyst, for example, ammonium nitrate, potassium nitrate, oxides and salts of chromium, manganese, vanadium, iron, cobalt and nickel, or bases such as potassium, sodium and ammonium hydroxides, and organic bases.

The Schulz et al U.S. Pat. No. 4,305,728 discloses coal suspensions which are prepared from water and the product resulting from the reaction of coal and a base such as, for example, sodium, potassium or calcium hydroxide. The coal suspensions are used in transporting the coal. The Lahart U.S. Pat. No. 1,555,590 discloses a method for treating coal which increases the completeness of combustion and results in the development of greater heat energy. The process comprises mixing the coal with common salt, unslacked lime and Portland cement. British Patent No. 505,729 discloses a further process for producing solid fuels and motor fuels by affecting the oxidation of coal extracts. The extracts are contacted with a stream of air or oxygen-containing gases at raised temperatures, for example 80° C. to 250° C. Finally, European Patent Application No. 237,122 and *Chemical Abstracts,* Vol. 109, 230324g (1988) and 39641d (1988) disclose methods for treating aqueous solutions of alkaline salts of humic acids. Calcium hydroxide is disclosed as a precipitating agent.

However, none of these prior art references teaches a method for treating coal refuse piles and a substantial need exists for providing such a method which reduces the environmental hazards associated with such materials.

SUMMARY OF THE INVENTION

Accordingly, it is an object of the present invention to provide a method for treating coal refuse piles. It is a further object of the invention to provide a method for treating coal refuse piles wherein the environmental hazards associated with such materials are significantly reduced. Related objects of the invention include reducing the tendency of coal refuse piles towards spontaneous combustion and reducing acid drainage from such materials. It is a further object of the invention to provide such methods which are particularly suitable for use in treating coal refuse piles containing up to several million tons or more of material. It is an additional object of the invention to provide methods for treating coal refuse piles which are less costly as compared with previously employed treatment techniques.

These and additional objects are provided by the present invention which relates to methods of extracting coal from a coal refuse pile. More particularly, the methods according to the present invention comprise soaking the coal refuse pile with an aqueous alkali solution, distributing an oxygen-containing gas throughout the coal refuse pile for a time period sufficient to effect oxidation of coal contained in the pile, leaching the coal refuse pile with an aqueous alkali solution to solubilize and extract the oxidized coal as alkali salts of humic acids, and collecting the resulting solution containing the alkali salts of humic acids. As a result of the present methods, the coal is removed from the refuse pile whereby the tendency towards spontaneous combustion is eliminated. Moreover, as a result, acid drainage from the refuse pile is significantly reduced. Because the present methods may be performed in the coal refuse pile in situ, excavation and transport of the refuse pile is not required. Moreover, the present methods may be performed at ambient temperature and pressure, whereby the present methods are further suited for in situ application.

These and additional objects and advantages provided by the present methods will be more fully understood in view of the following detailed description.

DETAILED DESCRIPTION

The present invention relates to methods of extracting coal from a coal refuse pile. The methods according to the invention reduce the tendency of such materials towards spontaneous combustion and reduce acid drainage from such materials. Thus, the methods according to the present invention prevent both air and water pollution from coal refuse piles. As noted above, such coal refuse piles generally contain from about 30 to about 70 weight percent coal. These materials are located throughout the United States, with more than 2,000 coal refuse piles, each containing several million tons, located in the Appalachian states alone.

Generally, the methods according to the present invention combine the techniques of wet oxidation and heap alkali leaching wherein oxidation of the coal is effected by an oxygen-containing gas such as air and is catalyzed by the use of an aqueous alkali solution. The wet oxidation converts the coal into humic acids which dissolve in alkali solutions or water and are therefore amenable to alkali leaching. Simultaneously, pyritic sulfur contained in the coal oxidizes to alkali sulfates which also dissolve in the alkali solutions. Thus, the coal constituents from the refuse pile may be removed from the remaining waste materials whereby many of the environmental problems associated with the coal refuse piles are significantly reduced.

The methods according to the present invention comprise soaking the coal refuse pile with an aqueous alkali solution. For example, the pile or heap may be sprayed with an aqueous alkali solution comprising an alkali hydroxide or an alkali carbonate. Preferred aqueous alkali solutions are formed from sodium hydroxide or sodium carbonate and have a concentration of, for example, about 0.5 Normal. It is further preferred that the coal refuse pile is soaked with the aqueous alkali solution for a time period of several days. During this time, the alkali solution may be recycled through the pile one or more times if desired. Erroded inorganics such as clay and the like may be removed from the recycle alkali solution and discarded as fill as necessary in order to prevent subsequent contamination of the oxidized coal products.

In the following step, an oxygen-containing gas is distributed throughout the coal refuse pile for a time period sufficient to effect oxidation of coal contained in the coal refuse pile. The aqueous alkali solution which has been soaked through the pile acts as a catalyst in the wet oxidation of the coal. For example, perforated pipes may be implanted throughout the pile whereby the oxygencontaining gas is pumped through the perforated pipes. If the refuse pile or heap appears to have inadequate permeability for implantation of such perforated pipes or for otherwise distributing an oxygen-containing gas therethrough, small explosive charges may be used to fragmentize the refuse pile and provide the desired permeability. In one embodiment, the oxygen-containing gas comprises ambient air. In a second embodiment, the oxygen-containing gas comprises a mixture of ambient air and ozone. Preliminary results indicate that a small amount of ozone, for example from about 1 to about 5 weight percent, based on the weight of the air, significantly improves the oxidation rate in the coal refuse pile.

The oxygen-containing gas is distributed throughout the coal refuse pile at a rate and for a time period sufficient to effect oxidation of coal contained in the material. It is preferred that the oxygen-containing gas is distributed throughout the refuse pile at a sufficiently high rate that the oxygen-containing gas exiting the refuse pile contains at least 5 weight percent oxygen. This precludes the occurrence of oxygen starvation within the refuse pile. Although the time necessary for conducting this step will vary depending on the size of the coal refuse pile, it is preferred that the oxidation step be continued for a period of about 4 to 6 months. Because this step merely comprises distributing the oxygen-containing gas throughout the pile, continual supervision or monitoring is generally not required.

In the next step, the coal refuse pile is leached with an aqueous alkali solution in order to solubilize and extract the oxidized coal as alkali salts of humic acids. Again, it is preferred that the aqueous alkali solution is formed from an alkali hydroxide or carbonate, and more preferably, sodium hydroxide or sodium carbonate. The leaching rate is generally dependent on the permeability of the refuse pile and should be adjusted to the point where leachant from the pile contains at least about 2 percent humic acids product but no more than about 10 percent humic acids product, by weight. If the leaching rate is adjusted so that greater than about 10 percent by weight humic acids product are contained in the leachant, an unsuitably high viscosity is exhibited and difficulty is encountered in subsequent separation processes.

Finally, according to the methods of the present invention, the resulting solution, i.e., the pregnant solution containing the alkali salts of humic acids, is collected from the refuse pile. For example, the solution containing the alkali salts of humic acids may be collected by means of dikes or the like surrounding the refuse pile. The solution may be subjected to subsequent processing in order to further process the humic acid materials and/or to recycle the alkali solution.

The methods according to the present invention are particularly advantageous in that they are conducted at ambient temperature and pressure and thus are suitable for treating of coal refuse piles in situ. Ambient temperatures in the range of about 60 to about 80° F. are suitable, with lower and higher ambient temperatures, depending on the climate of the geographical area in which the refuse piles are located, also allowing use of the present methods in extracting coal from the refuse piles.

In a further embodiment, the methods of the present invention comprise treating the resulting solution containing alkali salts of humic acids in order to separate the humic acid materials and the alkali solution. The alkali solution may be recycled for use in a repeat treatment of a previously treated refuse pile or for use in the original treatment of a nontreated refuse pile. More particularly, a precipitating agent such as calcium hydroxide is added to the resulting solution containing the alkali salts of humic acids in order to produce precipitated calcium humates and an alkali solution. The precipitated calcium humates may be collected by filtration and the supernatent liquid comprising the alkali solution may be regenerated for recycling. The calcium humate filter cake is then dried to produce a directly useable low-ash, low-sulfur solid fuel. Thus, the methods of the invention not only provide a process for reducing air and water pollution from coal refuse piles at minimal cost, a recovered clean coal product is produced.

According to further embodiments of the present invention, the soaking, oxidation, leaching and collecting steps as discussed above may be repeated until no further humic acid materials are produced in the leachant product stream. When repeating this series of steps, the oxidation time period may be reduced, for example to about 2 months or so as compared with the 4 to 6 months which is preferred for the first series of treatment steps.

The preceding description is set forth to illustrate specific embodiments of the invention and is not intended to limit the scope of the methods of the present invention. Additional embodiments and advantages within the scope of the claimed invention will be apparent to one of ordinary skill in the art.

What is claimed is:

1. A method of extracting coal from a coal refuse pile, comprising (a) soaking the coal refuse pile with an aqueous alkali solution;

(b) distributing an oxygen-containing gas throughout the coal refuse pile for a time period sufficient to effect oxidation of coal contained in the coal refuse pile;

(c) leaching the coal refuse pile with an aqueous alkali solution to solubilize and extract the oxidized coal as alkali salts of humic acids; and (d) collecting the resulting solution containing the alkali salts of humic acids, wherein said method is conducted at ambient pressure.

2. A method of extracting coal from a coal refuse pile as defined by claim 1, wherein said method is conducted at ambient temperature.

3. A method as defined by claim 2, wherein the ambient temperature is in the range of from about 60 to about 80° F.

4. A method as defined by claim 1, wherein said aqueous alkali solution comprises an alkali hydroxide.

5. A method as defined by claim 4, wherein said alkali hydroxide comprises sodium hydroxide.

6. A method as defined by claim 1, wherein said aqueous alkali solution comprises sodium carbonate.

7. A method as defined by claim 1, wherein said oxygen-containing gas comprises ambient air.

8. A method as defined by claim 7, wherein said oxygen-containing gas further comprises ozone.

9. A method as defined by claim 8, wherein said oxygen-containing gas comprises from about 1 to about 5 weight percent ozone.

10. A method as defined by claim 1, wherein the oxygen-containing gas is distributed throughout the coal refuse pile at a sufficiently high rate that the oxygencontaining gas exiting the coal refuse pile contains at least 5 weight percent oxygen.

11. A method as defined by claim 1, wherein said oxygen-containing gas is distributed throughout the coal refuse pile for about 4 to about 6 months.

12. A method as defined by claim 1, wherein said leaching is performed at a rate sufficient to provide the resulting solution of alkali salts of humic acids with a concentration of said alkali salts in the range of from about 2 to about 10 weight percent.

13. A method as defined by claim 1, further comprising adding calcium hydroxide to the resulting solution containing alkali salts of humic acids to produce precipitated calcium humates and an alkali solution.

14. A method as defined by claim 13, further comprising collecting the precipitated calcium humates from the alkali solution.

* * * * *